US007538466B2

(12) United States Patent
Chang et al.

(10) Patent No.: US 7,538,466 B2
(45) Date of Patent: May 26, 2009

(54) DUAL FAN AND DUAL MOTOR STRUCTURE THEREOF

(75) Inventors: Shun-Chen Chang, Taoyuan Hsien (TW); Po-Hao Yu, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 414 days.

(21) Appl. No.: 11/453,016

(22) Filed: Jun. 15, 2006

(65) Prior Publication Data

US 2007/0020128 A1 Jan. 25, 2007

(30) Foreign Application Priority Data

Jun. 30, 2005 (TW) ..... 94122133 A

(51) Int. Cl.
*H02K 16/00* (2006.01)

(52) U.S. Cl. ..... 310/112; 310/67 R

(58) Field of Classification Search ..... 310/112, 310/67 R, 90

See application file for complete search history.

(56) References Cited

U.S. PATENT DOCUMENTS 5,258,676 A * 11/1993 Reinhardt et al. ..... 310/112
5,674,169 A * 10/1997 Yang ..... 483/32
7,112,905 B2 * 9/2006 Chang et al. ..... 310/112

* cited by examiner

*Primary Examiner*—Gary F Paumen
(74) *Attorney, Agent, or Firm*—Birch, Stewart, Kolasch & Birch, LLP

(57) ABSTRACT

A dual motor structure of a dual fan includes a first stator structure, a first rotor structure, a first bearing, a second stator structure, a second rotor structure and a second bearing. The first stator structure has a first bearing tube. The first rotor structure has a first shaft inserted into the first bearing tube. The first bearing is telescope onto the first shaft, and is mounted in the first bearing tube. The second stator structure has a second bearing tube. The second rotor structure has a second shaft inserted into the second bearing tube. The second bearing is telescope onto the second shaft, and is mounted in the second bearing tube. The first shaft is positioned corresponding to the second shaft to generate a magnetic interaction therebetween.

20 Claims, 3 Drawing Sheets

DUAL FAN AND DUAL MOTOR STRUCTURE THEREOF

BACKGROUND OF THE INVENTION

1. Field of Invention

The present invention relates to a dual fan and a dual motor structure thereof, and more particularly, to a dual fan and a dual motor structure thereof with magnetic structure.

2. Related Art

Accompanying to the development of technologies, the integration of the electronic devices is greatly upgraded and heat dissipated from the electronic devices is thus increased. Thermal dissipation becomes more important for maintaining the operation temperature. In the prior art, thermal dissipating structure is generally a fan set or a fan cooperating with a thermal sink. In order to enhance usage efficiency, a dual fan structure is constructed by two independent fans.

In a conventional motor structure or rotor of the fan, a four-points type support is constructed by each shaft threading through two bearings. However, the reliability of the motor structure or the fan is affected by the lifetime, accuracy in assembly, smooth operation of the bearing. Therefore, how to decrease the amount of the bearing, save the cost and raise the reliability has become an essential subject to the rotating structure of the fan and the motor structure thereof.

SUMMARY OF THE INVENTION

In view of the foregoing, the present invention provides a dual fan and a dual motor structure thereof to decrease the amount of the bearing, save the cost and raise the reliability by means of magnetic structure.

To achieve the above, a dual motor structure according to the present invention includes a first stator structure, a first rotor structure, a first bearing, a second stator structure, a second rotor structure and a second bearing. The first stator structure and the second stator structure respectively have a first bearing tube and a second bearing tube. The first rotor structure and the second rotor structure respectively have a first shaft and a second shaft. The first shaft and the second shaft are respectively inserted into the first bearing tube and the second bearing tube. The first bearing is disposed in the first bearing tube for supporting the first shaft, and the second bearing is disposed in the second bearing tube for supporting the second shaft. The other end of the first shaft is corresponding to the other end of the second shaft, and which have magnetic interaction therebetween.

To achieve the above, another dual motor structure according to the present invention includes a first stator structure, a first rotor structure, a first bearing, a second stator structure, a second rotor structure, a second bearing and a first magnetic element. The first stator structure and the second stator structure respectively have a first bearing tube and a second bearing tube. The first rotor structure and the second rotor structure respectively have a first shaft and a second shaft. The first shaft and the second shaft are respectively inserted into the first bearing tube and the second bearing tube. The first bearing and the second bearing are respectively telescope onto and adjacent to one ends of the first shaft and the second shaft, and are respectively mounted in the first bearing tube and the second bearing tube. The first magnetic element is disposed between the other end of the first shaft and the other end of the second shaft, and the first magnetic element respectively have magnetic interaction between the first shaft and between the second shaft. The other end of the first shaft is corresponding to the other end of the second shaft.

To achieve the above, a dual fan according to the present invention includes a first impeller, a first motor structure, a second impeller and a second motor structure. The first motor structure and the second motor structure respectively connect with and drive the first impeller and the second impeller. The first motor structure includes a first shaft and a first bearing. The second motor structure includes a second shaft and a second bearing. The first bearing and the second bearing are respectively telescope onto and adjacent to one ends of the first shaft and the second shaft. The other end of the first shaft is corresponding to the other end of the second shaft, and which have magnetic interaction therebetween.

To achieve the above, another dual fan according to the present invention includes a first impeller, a first motor structure, a second impeller, a second motor structure and a first magnetic element. The first motor structure and the second motor structure respectively connect with and drive the first impeller and the second impeller. The first motor structure includes a first shaft and a first bearing. The second motor structure includes a second shaft and a second bearing. The first bearing and the second bearing are respectively telescope onto and adjacent to one ends of the first shaft and the second shaft. The first magnetic element is disposed between the other end of the first shaft and the other end of the second shaft, and the first magnetic element respectively have magnetic interaction between the first shaft and between the second shaft. The other end of the first shaft is corresponding to the other end of the second shaft.

As mentioned above, due to the conventional rectangular support constructed by two bearings is replaced with a three-points type support constructed by the magnetic structure and a bearing, the amount of the bearing can be decreased. Comparing with the prior art, a dual fan and a dual motor structure thereof according to the present invention can save the cost and raise the reliability by means of the magnetic interaction of the magnetic structure. The orientation of the rotating structure can thus be simultaneously maintained.

BRIEF DESCRIPTION OF THE DRAWINGS

The present invention will become more fully understood from the detailed description given herein below illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
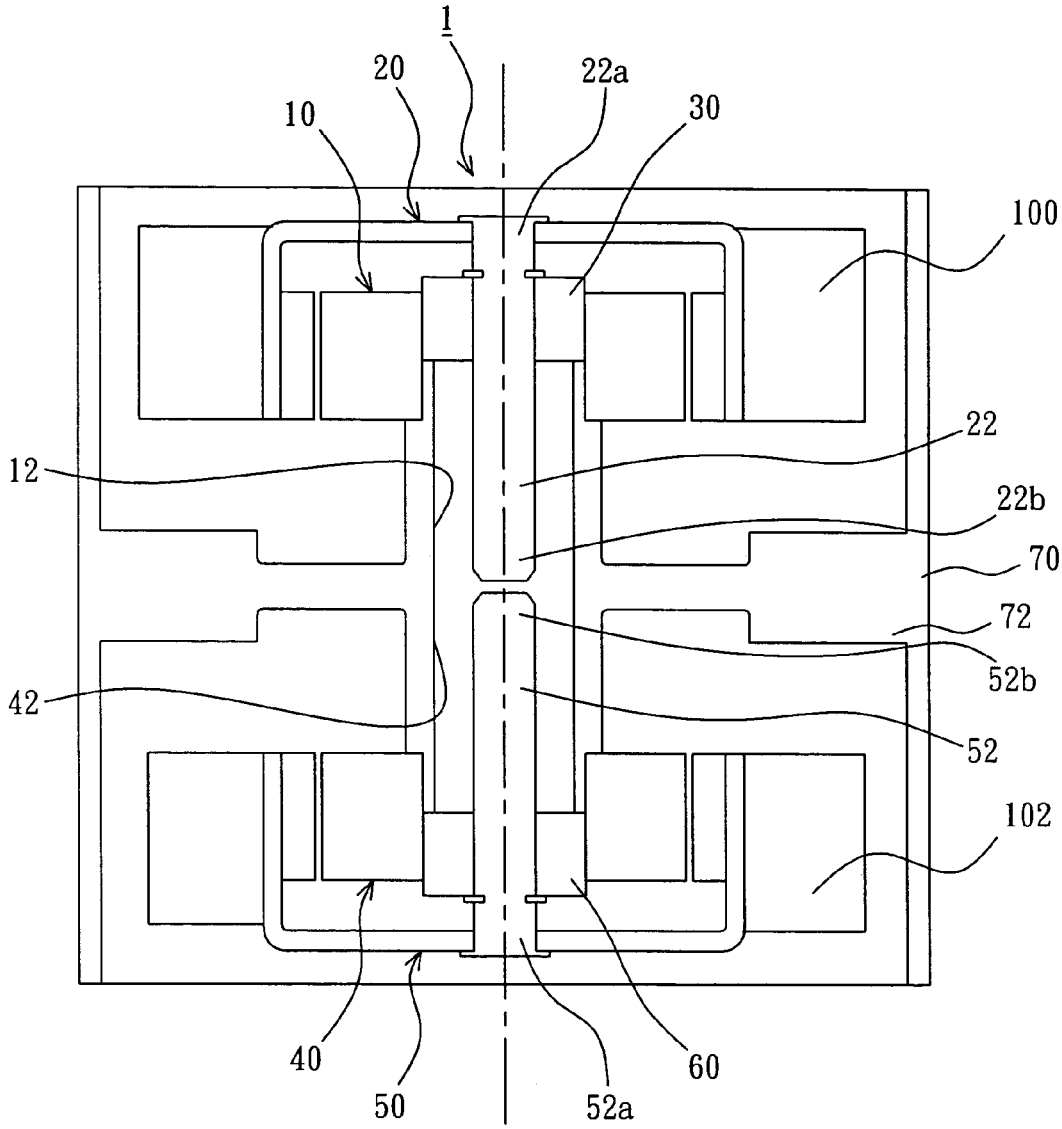
FIG. 1 is a schematic view showing a dual motor structure according to a first embodiment of the present invention and a dual fan according to the present invention.

As shown in FIG. 1, a dual motor structure 1 according to a first embodiment of the present invention includes a first stator structure 10, a first rotor structure 20, a first bearing 30, a second stator structure 40, a second rotor structure 50 and a second bearing 60. The first stator structure 10 and the second stator structure 40 respectively have a first bearing tube 12 and a second bearing tube 42. The first rotor structure 20 and the second rotor structure 50 respectively have a first shaft 22 and a second shaft 52. The first shaft 22 and the second shaft 52 are respectively inserted into the first bearing tube 12 and the second bearing tube 42. The first bearing 30 and the second bearing 60 are respectively telescope onto and adjacent to one ends 22*a*, 52*a* of the first shaft 22 and the second shaft 52, and are respectively mounted in the first bearing tube 12 and the second bearing tube 42. The other end 22*b* of the first shaft 22 is corresponding to the other end 52*b* of the second shaft 52, and which have magnetic interaction therebetween. A plurality of blades 100, 102 may be respectively disposed on a circumference of an outer wall of the rotor structures 20, 50.

As shown in FIG. 1, the other ends 22*b*, 52*b* of the first shaft 22 and the second shaft 52 are flat, tapered, or with a guiding angle. The guiding angle may be an arc angle, a cone angle, a bevel angle or a polygon angle. The first bearing tube 12 and the second bearing tube 42 may be integrally formed as a single piece.

The first bearing 30 and the second bearing 60 may be respectively a ball bearing, a roller bearing, an oil-containing bearing, a dynamic-pressure bearing, a sleeve bearing or other bearings.

The dual motor structure 1 may be accommodated or covered in a housing 70. The housing 70 has a rib 72 to reinforce the strength of the structure. The rib 72 may support the first stator structure 10 and the second stator structure 40. In addition, the housing 70 may be integrally formed as a single piece or combined with a plurality of separated members.

A rotating structure of a dual fan according to the present invention is composed of the first shaft 22, the first bearing 30, the first shaft 52 and the first bearing 60. Due to a three-points type support and orientation are constructed by the magnetic interaction between the corresponding ends of the shafts and the bearings, the present invention may be more simplified in structure and easily assembled.

Owing to the detailed constructions and connections of the motor structure, such as coil and magnet, etc., are not major technical characteristics of the present invention, so detailed descriptions thereof will be omitted.

Figure 2:
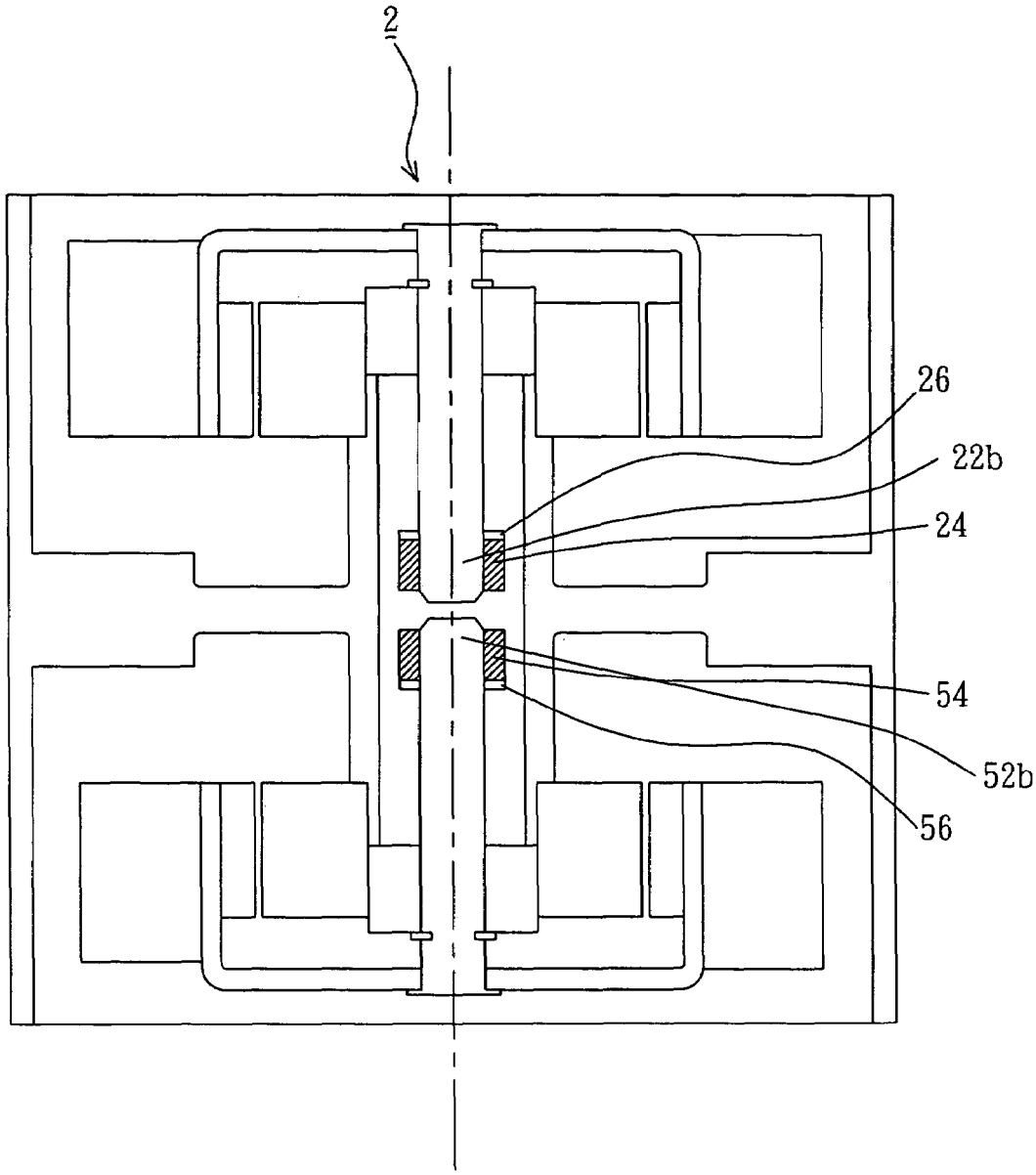
FIG. 2 is a schematic view showing a dual motor structure according to a second embodiment of the present invention and a dual fan according to the present invention.

As shown in FIG. 2, a dual motor structure 2 according to a second embodiment of the present invention has substantially the same constructions, connections and functions as those of the first embodiment. The major difference of this embodiment is that the dual motor structure 2 may further comprise a first magnetic element 24 and a second magnetic element 54 respectively mounted on the other ends 22*b*, 52*b* of the first shaft 22 and the second shaft 52. The first magnetic element 24 and the second magnetic element 54 may be respectively a magnet, an electromagnet or the combination. The other ends 22*b*, 52*b* may be magnetic or non-magnetic.

In order to adjust the magnetic distribution, the dual motor structure 2 may further comprise at least one magnetically conductive element 26, 56 respectively connected with the first magnetic element 24 and/or the second magnetic element 54. In this embodiment, the dual motor structure 2 can only have one of the first magnetic element 24 and the second magnetic element 54.

Figure 3:
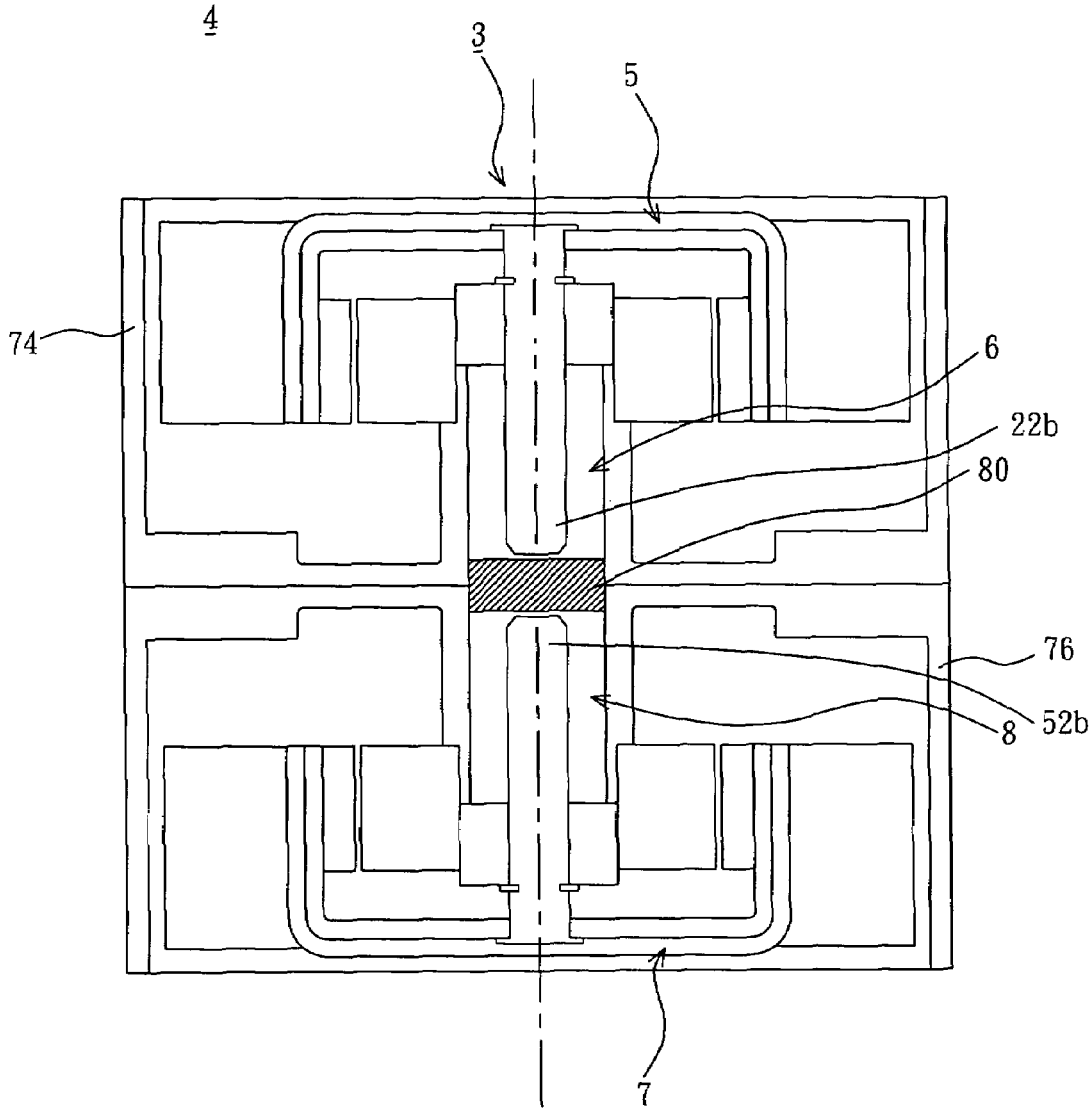
FIG. 3 is a schematic view showing a dual motor structure according to a third embodiment of the present invention and a dual fan according to the present invention.

As shown in FIG. 3, a dual motor structure 3 according to a third embodiment of the present invention has substantially the same constructions, connections and functions as those of the first embodiment. The major difference of this embodiment is that the dual motor structure 3 may further comprise a third magnetic element 80 disposed between and adjacent to the other ends 22*b*, 52*b* of the first shaft 22 and the second shaft 52. The third magnetic element 80 may be a magnet, an electromagnet or the combination. Preferably, the third magnetic element 80 is not contacted with the other ends 22*b*, 52*b*. However, the third magnetic element 80 may contact with the other ends 22*b*, 52*b* in accordance with practical requirements. The other ends 22*b*, 52*b* may be magnetic or non-magnetic. In addition, if all of the other ends 22*b*, 52*b* are magnetic, the third magnetic element 80 may be a magnetically conductive structure with no magnetism. When the third magnetic element 80 contacts with the other ends 22*b*, 52*b*, the third magnetic element 80 also can be replaced by a structure with no magnetism.

A first motor structure 6 and a second motor structure 8 may be respectively accommodated in a first housing 74 and a second housing 76. The first housing 74 and the second housing 76 may be combined together or be integrally formed as a single piece.

Owing to the detailed constructions, connections and functions of this embodiment are substantially the same as those of the first embodiment, so detailed descriptions thereof will be omitted.

In summary, due to the conventional rectangular support constructed by two bearings is replaced with a three-points type support constructed by the magnetic structure and a bearing, the amount of the bearing can be decreased. Comparing with the prior art, a dual fan and a dual motor structure thereof according to the present invention can save the cost and raise the reliability by means of the magnetic interaction of the magnetic structure. The orientation of the rotating structure can thus be simultaneously maintained.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A dual motor structure, comprising:

a first stator structure having a first bearing tube;

a first rotor structure having a first shaft inserted into the first bearing tube;

a first bearing disposed in the first bearing tube for supporting the first shaft;

a second stator structure having a second bearing tube;

a second rotor structure having a second shaft inserted into the second bearing tube; and a second bearing is disposed in the second bearing tube for supporting the second shaft;

wherein the first shaft is positioned corresponding to the second shaft to generate a magnetic interaction therebetween.

2. The dual motor structure according to claim 1, further comprising a first magnetic element mounted on the first shaft.

3. The dual motor structure according to claim 2, further comprising a second magnetic element mounted on the second shaft.

4. The dual motor structure according to claim 3, further comprising at least one magnetically conductive element respectively connected with the first magnetic element and/or the second magnetic element.

5. The dual motor structure according to claim 1, further comprising a third magnetic element, a magnetically conductive structure and/or a non-magnetic structure disposed between the first shaft and the second shaft.

6. The dual motor structure according to claim 1, wherein the first shaft and the second shaft have flat ends, tapered ends, or ends with a guiding angle.

7. The dual motor structure according to claim 6, wherein the guiding angle is an arc angle, a cone angle, a bevel angle or a polygon angle.

8. The dual motor structure according to claim 1, wherein the first bearing tube and the second bearing tube are integrally formed as a single piece.

9. The dual motor structure according to claim 1, further comprising a housing for accommodating the first stator structure, the first rotor structure, the second stator structure and the second rotor structure, wherein the housing has a rib for supporting the first stator structure and the second stator structure.

10. A dual fan, comprising:

a first impeller;

a first motor structure connecting with and driving the first impeller, and comprising a first shaft and a first bearing telescope onto the first shaft;

a second impeller; and a second motor structure connecting with and driving the second impeller, and comprising a second shaft and a second bearing telescope onto the second shaft;

wherein the first shaft is positioned corresponding to the second shaft to generate a magnetic interaction therebetween.

11. The dual fan according to claim 10, further comprising a first magnetic element mounted on the first shaft.

12. The dual fan according to claim 11, further comprising a second magnetic element mounted on the second shaft.

13. The dual fan according to claim 12, further comprising at least one magnetically conductive element respectively connected with the first magnetic element and/or the second magnetic element.

14. The dual fan according to claim 10, further comprising a third magnetic element, a magnetically conductive structure and/or a non-magnetic structure disposed between the first shaft and the second shaft.

15. The dual fan according to claim 10, wherein the first shaft and the second shaft have flat ends, tapered ends, or ends with a guiding angle.

16. The dual fan according to claim 15, wherein the guiding angle is an arc angle, a cone angle, a bevel angle or a polygon angle.

17. The dual fan according to claim 10, further comprising a housing for accommodating the first motor structure, the first impeller, the second motor structure and the second impeller, wherein the housing has a rib for supporting the first motor structure and the second motor structure.

18. A dual fan, comprising:

a first impeller;

a first motor structure connecting with and driving the first impeller, and comprising a first shaft and a first bearing for supporting to the first shaft;

a second impeller;

a second motor structure connecting with and driving the second impeller, and comprising a second shaft and a second bearing for supporting to the second shaft; and an intermediate element disposed between the first shaft and the second shaft, and contacted with the other end of the first shaft and the other end of the second shaft;

wherein the first shaft is supported by the intermediate element and the first bearing, and the second shaft is supported by the intermediate element and the second bearing.

19. The dual fan according to claim 18, wherein the intermediate element is a magnetic element, a magnetically conductive structure or a non-magnetic structure.

20. The dual fan according to claim 18, wherein the first shaft is corresponding to the second shaft, and which have magnetic interaction therebetween.

* * * * *